US006530092B2

(12) United States Patent
Pope

(10) Patent No.: US 6,530,092 B2
(45) Date of Patent: Mar. 11, 2003

(54) FITTING AND COMFORT SYSTEM WITH INFLATABLE LINER FOR HELMET

(75) Inventor: Dean F. Pope, Cynthiana, KY (US)

(73) Assignee: Southern Impact Research Center, LLC, Knoxville, TN (US)

( * ) Notice: Subject to any disclaimer, the term of this patent is extended or adjusted under 35 U.S.C. 154(b) by 0 days.

(21) Appl. No.: 09/851,806

(22) Filed: May 9, 2001

(65) Prior Publication Data

US 2002/0166157 A1 Nov. 14, 2002

(51) Int. Cl.[7] ..... A42B 3/00
(52) U.S. Cl. ..... 2/413; 2/DIG. 3
(58) Field of Search ..... 2/411, 413, DIG. 3, 2/DIG. 10, 425, 417, 418

(56) References Cited

U.S. PATENT DOCUMENTS

| | | | | |
|---|---|---|---|---|
| 3,668,704 | A | * | 6/1972 | Conroy et al. |
| 3,713,640 | A | | 1/1973 | Margan |
| 3,994,020 | A | | 11/1976 | Villari |
| 3,999,220 | A | | 12/1976 | Keltner |
| 4,023,213 | A | * | 5/1977 | Rovani |
| 4,287,613 | A | | 9/1981 | Schulz |
| 4,566,137 | A | | 1/1986 | Gooding |
| 5,083,320 | A | | 1/1992 | Halstead |
| 5,175,889 | A | | 1/1993 | Infusino |
| 5,263,203 | A | | 11/1993 | Kraemer et al. |
| 5,298,208 | A | | 3/1994 | Sibley et al. |
| 5,815,846 | A | | 10/1998 | Calonge |
| 6,073,271 | A | | 6/2000 | Alexander et al. |
| 6,178,560 | B1 | | 1/2001 | Halstead et al. |
| 6,219,850 | B1 | | 4/2001 | Halstead et al. |

FOREIGN PATENT DOCUMENTS

| | | | |
|---|---|---|---|
| EP | 0 423 711 A1 | | 4/1991 |
| GB | 2134370 | * | 8/1984 |

* cited by examiner

*Primary Examiner*—Rodney M. Lindsey
(74) *Attorney, Agent, or Firm*—Luedeka, Neely & Graham PC

(57) ABSTRACT

An inflatable liner for a helmet. The liner has a first elongated cell and a second elongated cell extending substantially parallel to the first elongated cell. Passages extend through the first divider to permit air to pass between the first and second cells during an impact event. The second elongated cell is divided into separate sub cells and a single air inlet is provided for introducing air into the liner.

2 Claims, 3 Drawing Sheets

FITTING AND COMFORT SYSTEM WITH INFLATABLE LINER FOR HELMET

FIELD OF THE INVENTION

The present invention relates to a fitting and comfort system for a helmet, such as a football helmet, and more particularly features an inflatable liner and its relationship to the helmet that provides substantially enhanced fitting capability, and elimination of lift of the helmet during inflation of the liner and upon impact, along with increased comfort for the user.

BACKGROUND OF THE INVENTION

The technology and science of improving the impact attenuation in helmets, and more particularly in a football helmet, has experienced substantial strides in the past two decades. Coupled with impact attenuation, there have been some attempts to improve the fit and comfort of the helmet in order to improve the quality of enjoyment of the game for the players. However, it is generally accepted that the fitting and comfort system development has fallen behind the technology involving the impact attenuation and absorption features.

A typical early approach to improving the impact characteristics of a football helmet are illustrated in several prior patents, including the patent to Schulz issued on Sep. 8, 1981; U.S. Pat. No. 4,287,613. As illustrated in this patent, the web suspension and resilient padding, as best illustrated in FIGS. 3 and 4, provides basic protection and impact attenuation for the user.

Typically, to provide the fit and comfort functions, air inflatable chambers are provided on the sides of the head and across the crown, as illustrated (see also FIG. 7). Additional impact attenuation/absorbing materials are provided around the back of the user's head, typically utilizing liquid filled chambers. While this approach to fit, comfort and impact attenuation was successful at the time, it has been improved over the past two decades to the level that now notably appears in applicant's own issued U.S. Pat. No. 6,219,850, issued Apr. 24, 2001.

As can be noted, the shape of the fit/comfort inflatable liner of the system (see FIGS. 7 and 8 of the '850 patent) is substantially similar to the corresponding system in the '613 patent. The inflatable liner is designed to extend in two separate components around the sides and with a cross-over in the center over the top or crown of the head. Just as in the '613 patent, this provision of inflatable members positioned in the top of the helmet and extending over the crown of the head of the user causes difficulty, most notably in creating lift effect during fitting and a bounce effect upon the helmet receiving an impact. While not sufficient to cause the helmet to release from the head, the bounce and lifting of the helmet from the head provides substantial discomfort to the user thus a change in the basic design is desirable.

Accordingly, it is contemplated to be a substantial advantage for a new fitting and comfort system for a helmet to eliminate the cross over that heretofore has been positioned across the crown of the head of the user and that connects the two side components together. With this top component eliminated, the inflatable fitting/comfort liner should not cause the helmet to rise up on the user's head during the fitting operation, or upon impact. In other words, with the cross over connection eliminated, there is nothing to inflate between the helmet and the crown of the user's head and thus the deleterious rise and bounce effect can be eliminated.

Furthermore, without the crown crossover component, the inflatable liner remains in place better during cleaning of the sweat and dirt that inevitably appears around the liner. This crossover component tends to catch on cleaning towels and rags, as well as on the trainer's hands during the cleaning operation, and tends to cause partial removal of the liner.

In addition to advancing the technology in terms of the operation of the inflatable liner that forms the fitting and comfort system, it is also desirable to have a reduction in size and complexity of the liner, and thus a reduction in the tooling and manufacturing costs. It is also desirable to simplify the shape of the inflatable liner which adds additional emphasis to the reduction and cost from prior approaches.

SUMMARY OF THE INVENTION

Considering the above shortcomings of the past development of a fitting and comfort system for helmets, such as for football helmets, the present invention provides a system having a shock attenuating member forming the inside of the helmet, and an inflatable liner assembly extending solely around the inside of the member from adjacent one side of the user's head around the back under the occipital protuberance of the head and back adjacent to the opposite side. Most notably, there is no cross over component that extends over the top or crown of the user's head, so that the problem of the helmet rising during inflation, or the bounce factor upon experiencing an impact, is eliminated. Advantageously, the liner includes a substantially continuous upper elongated cell formed by a flexible membrane engaging the head to create an upper band of engagement when inflated. A lower cell extends substantially parallel and forms a lower band of engagement with the sides of the user's head for additional snug, holding action. The cells are coupled adjacent at least one end of the membrane, and preferably at both ends, to form a continuous inflation path. The uninterrupted bands of the upper and lower cells generate separate holding forces that ensure a snug fit of the helmet under all foreseeable conditions. To provide the inflation of the system, a valve communicates with at least one of the cells.

The two cells of the inflatable liner of the present invention are substantially the same length. However, in the preferred embodiment, the lower cell is interrupted in the middle by a divider. In either case, the flow path during inflation by pressurized air is in one direction along the upper cell and in the opposite direction along the lower cell. The single inlet valve in the lower cell adjacent the divider is utilized to inflate the entire length of the cells and form the two continuous holding bands engaging the sides and back of the user's head.

The inflatable liner preferably includes a relatively stiff backing sheet that forms the surface of the liner positioned adjacent the shock attenuation member in the helmet. Fasteners, such as prongs that are inserted between elements of the shock attenuating member are used to maintain the inflatable liner securely in place. Since the liner is one continuous, preferably a shallow, wave-like form when laid out flat, and there is no crossover component that extends up into the top of the helmet, cleaning of the helmet during use is considerably easier than in the past.

In the preferred method of forming the inflatable liner, so as to be not only more effective in use, but also lower in cost, heat sealing elements are used to form a bead around the perimeter sealing the liner membrane to the backing sheet. A center divider heating element forms the center line bead along approximately the center of the cells to complete the liner assembly. The fasteners are also heat sealed to the backing sheet at spaced locations along the center line bead. It is also desirable to provide restricted bleed passages for controlled air transfer between the cells as needed during impact for balance of the holding forces between the upper and lower bands.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE INVENTION

Figure 1:
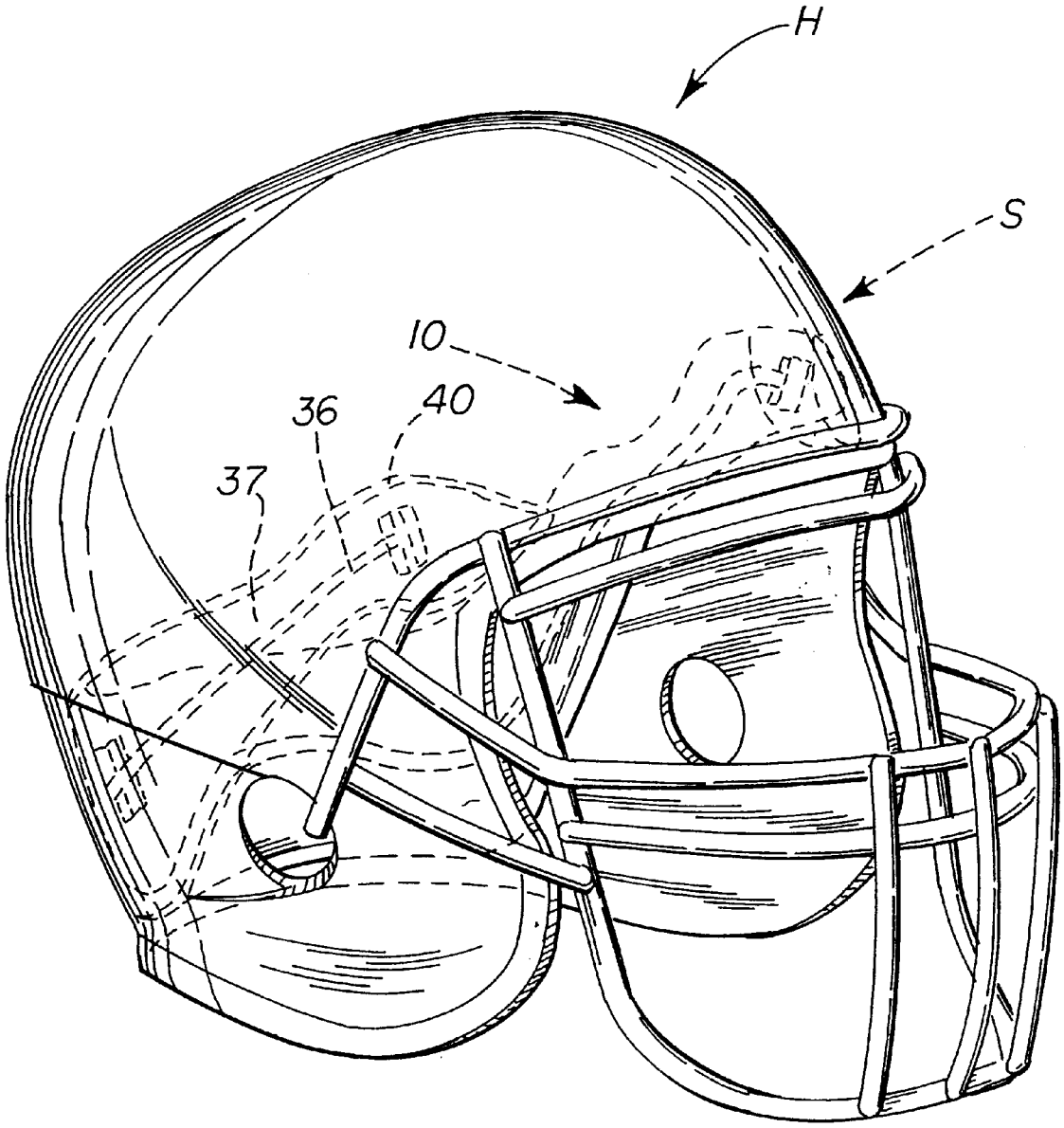
FIG. 1 is a perspective view of a helmet with the fitting and comfort system installed ready for use.
Figures 2, 2A, 4:
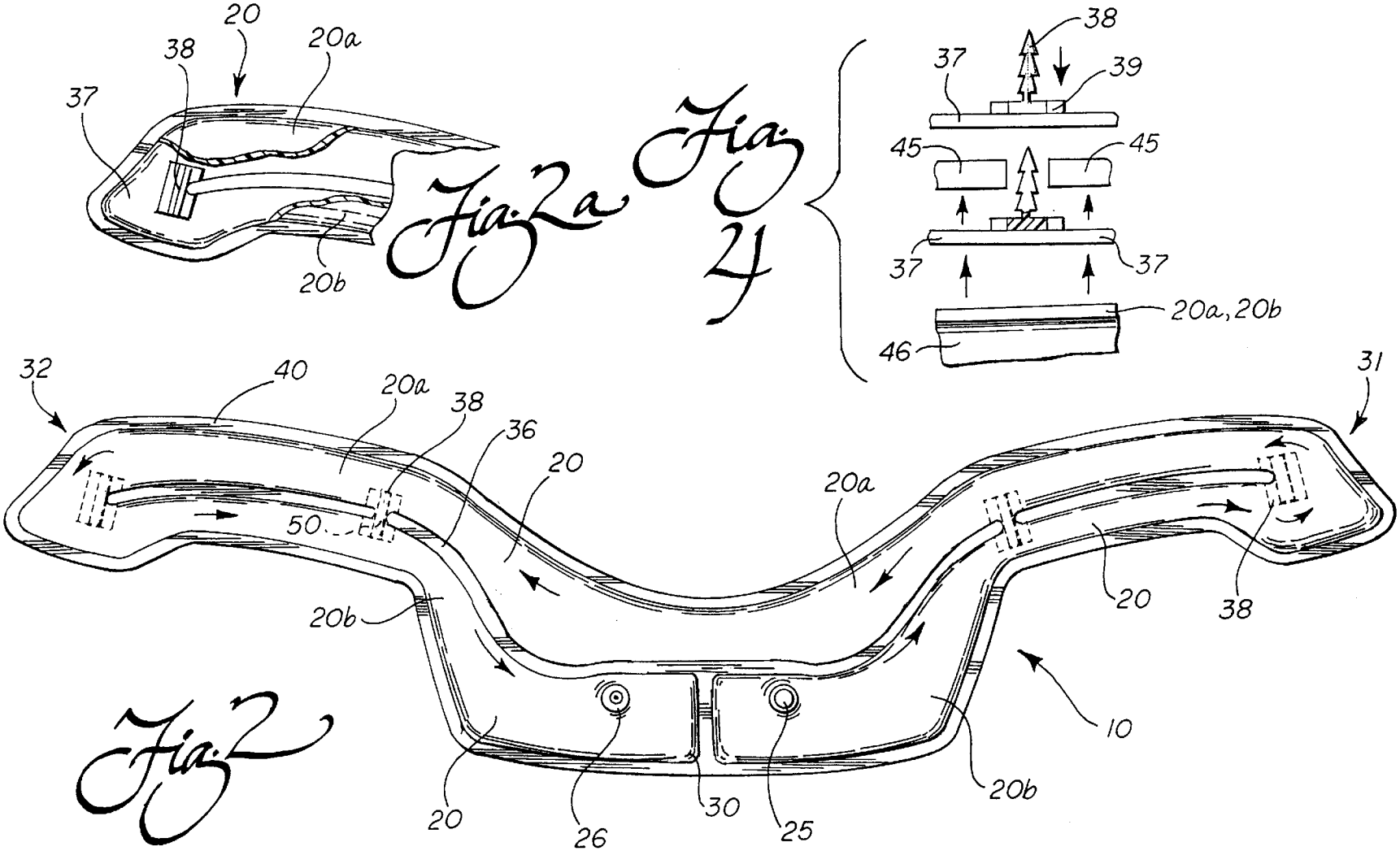
FIG. 2 is a plan view of the liner assembly of the fitting and comfort system illustrating the elongated wave-like shape, and viewed from the inflatable membrane side of the liner assembly.
FIG. 2A is a partial view of one end of the liner assembly but showing the reverse or backing sheet side of the liner assembly and partially broken away for clarity.
FIG. 4 is a schematic view showing the various steps of fabrication of the liner assembly including attachment of a fastener to the backing sheet and heat sealing the membrane to the backing sheet to form the perimeter and centerline heat seal beads.

With reference now to FIGS. 1 and 2 of the drawings, a helmet H is illustrated in order to provide a perspective view of the fitting and comfort system S with an inflatable liner assembly, generally designated by the reference numeral 10 and shown only in phantom in FIG. 1. As illustrated, the liner assembly 10 of the system S bends around the inside of the helmet H from adjacent one side of the user's head, around the back below the occipital protuberance, and then adjacent the opposite side. In plan view (FIG. 2) the wave-like shape of the liner assembly 10 is apparent (see FIG. 3 also). For a more detailed and complete description of the other inside components of the helmet H, reference can be made to applicant's issued U.S. Pat. No. 6,219,850, which is incorporated herein by reference.

Figure 3:
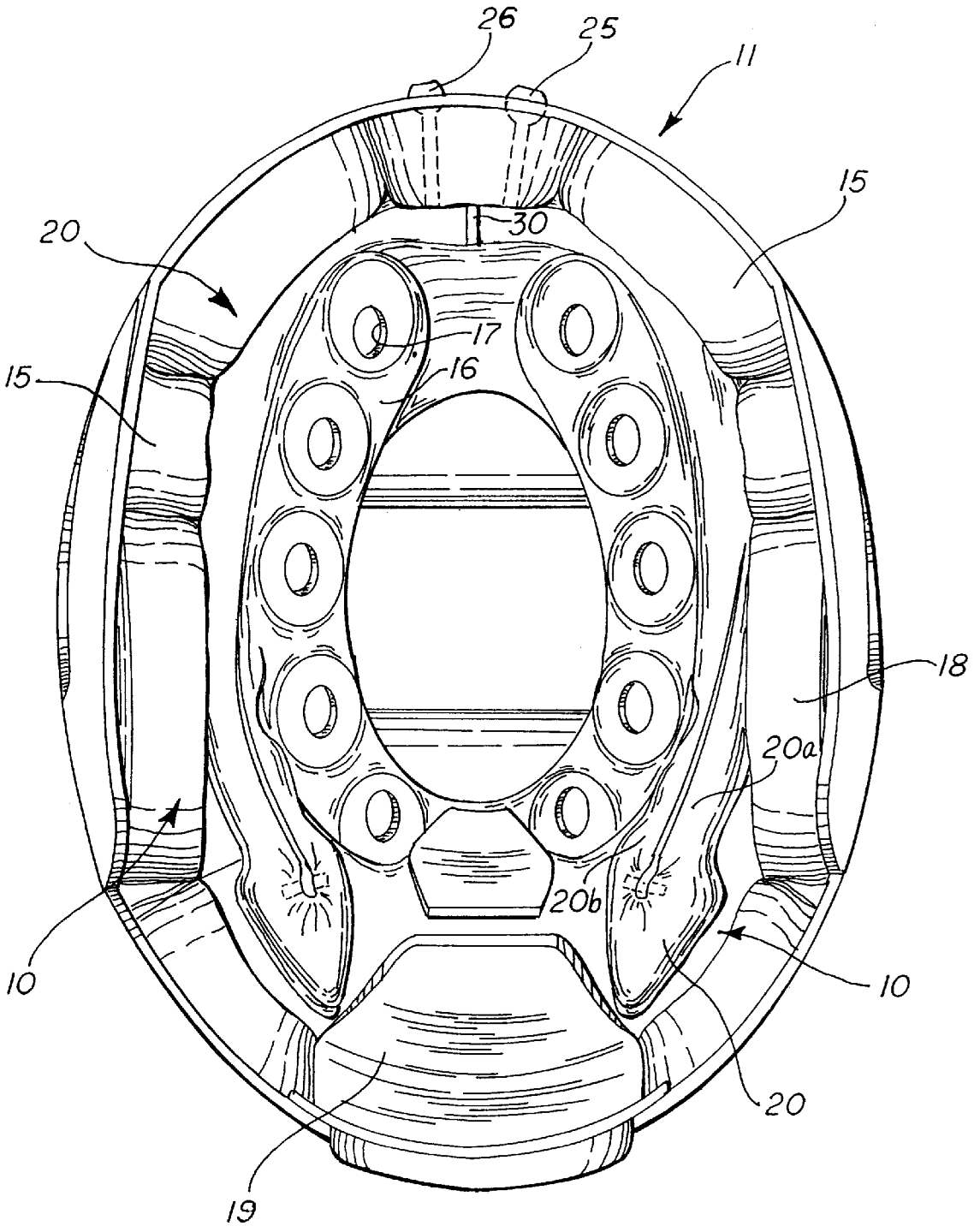
FIG. 3 is a bottom or inside view of the helmet of FIG. 1 illustrating the fitting and comfort system of the present invention with the liner assembly in place and inflated to extend the continuous membrane forming the elongated cells.

The helmet H includes a primary shock attenuating member 15 that supports the inflatable liner assembly 10 (see FIG. 3 and the '850 patent). The attenuating member 15 fits inside another or secondary shock attenuating shell, a portion of which is designated by the reference numeral 16. Recessed vent openings 17 are provided for ventilation, as more fully described in the '850 patent. Interchangeable jaw pads 18 are positioned at the bottom of the helmet, as illustrated. A frontal pad 19 forms a part of the primary shock attenuating member 15.

By viewing FIG. 2 in conjunction with FIG. 3, the liner assembly 10 can be seen to include a substantially continuous flexible membrane 20, which forms an upper elongated cell 20*a* and a lower elongated cell 20*b*. The liner assembly 10 is designed to engage the head of the user below the crown to define both an upper band of engagement by the upper cell 28 and the lower cell 20*b*. As best illustrated in FIG. 2, the lower cell 20*b* extends substantially parallel to the upper cell 20*a*, and as will be realized since they are substantially uninterrupted along their length, uninterrupted bands of engagement are provided generating separate holding forces to assure a snug fit of the helmet on the user's head. An air inlet valve 25 is provided at a position along the lower cell 20*b* to allow inflation during fitting of the helmet on the user's head. A sealed valve 26 is also provided, or in the alternative the valve 26 can be an exhaust valve, in the event that the fluid other than air, such as a liquid, is preferred for inflating the liner assembly.

At the midpoint of the liner assembly 10 along the lower cell 20*b*, a divider 30 is formed. As illustrated in FIG. 3, this divider 30 is positioned at the center of the back of the head with the inlet valve 25 on one side and the cap or exhaust valve on the opposite side. During operation, as the air is introduced into the bifurcated lower cell 20*b*, the pressurized air flows in one direction out to one end of the liner assembly 20, generally designated by the reference numeral 31 (note flow arrows shown), and around the end to flow in the opposite direction along the upper cell 20*a*. At the opposite end 32, the flow continues to complete the filling of the lower cell 20*b*, as shown.

It will now be realized that with the liner assembly 10 of the present invention, there is advantageously provided a fitting and comfort system wherein there is no requirement for a component extending across the crown of the head of the user, as has generally been the practice in the past, and as illustrated in both the '613 patent described above. Indeed, the entire inflatable liner assembly 10 is positioned below the crown of the head extending from one side, back below the occipital protuberance and continuing onto the opposite side of the head. As a result, when the liner assembly 10 is inflated to provide a fitting to the user's head, there is no tendency for the helmet to rise up. Similarly, during use in the event that an impact is provided to the helmet, there is no up and down bouncing that can be uncomfortable to the user.

With regard to the specific structure of the liner assembly 10 according to additional details of the present invention, the inflatable membrane 20 covers the entire inside surface. As illustrated in FIG. 2, this membrane 20 bulges inwardly against the head of the user forming the advantageous continuous bands of engagement around the user's head. A center line divider bead 36 separates the cells 20*a*, 20*b*. On the reverse side, as shown in FIG. 2A, a backing sheet 37 provides the necessary body to the liner assembly 20. While the membrane 20 is relatively flexible in order to bulge inwardly against the head of the user and conform to its contour, the rear backing sheet 37 is relatively stiff to provide the necessary body for positioning inside the attenuating member 15. In order to actually retain the liner assembly 20 in position, a plurality of mounting prongs 38 are heat sealed in position on the backing sheet 37 and engage between individual pads of the attenuating member 15 (see FIGS. 2, 2A and FIG. 4).

To fabricate the liner assembly 10 in the least expensive and most efficient manner, a process of heat sealing is employed. The liner membrane 20 forming the cells 20*a*, 20*b* is heat sealed to form a bead 40 around the perimeter; and back divider 30 and the center line divider bead 36 is also formed by heat sealing at the same time. As illustrated in FIG. 4, the mounting prong 38 with side notches in the base 39 is first heat sealed to the backing sheet 37, and then this subassembly is placed in a heat sealing platen with narrow heat seal elements 45, 46. The beads 36, 40 are formed once the elements 45, 46 are pressed together and heat is applied. A gap in the element 45 leaves a bleed passage 50 through the center divider bead 36 under each intermediate prong 38. This allows controlled, direct relief of air between the cells 20*a*, 20*b* upon experiencing an impact to equalize the pressure and thus the holding force. In this manner, a very economical and better operating inflatable liner assembly 10 can be formed. If desired within the broadest aspects of the present invention, adhesive may be applied along the lines of the back divider, center line and the perimeter, or any other suitable means of attachment can be made.

In summary, a superior performing helmet fitting and comfort system S is provided. The liner assembly 10 extends in the elongated wave-like shape and bends between the sides of the head and the back so that there is no portion in the upper part of the helmet to engage the crown. This provides for superior performance in terms of not rising during inflation or bouncing during impact during use. The liner includes separate upper and lower elongated cells 20*a*, 20*b* formed by the liner membrane 20 to engage and comfortably hold the helmet H in a snug fit when inflated. The cells 20*a*, 20*b* provide for a continuous inflation path around their ends. The center, cross-over component previously favored by the systems of the past is eliminated. The bands of engagement provided by the cells 20*a*, 20*b* increase the holding force, but also ensure the desirable comfortable fit against the user's head. Preferably, the liner assembly 10 is economically fabricated by heat sealing to form beads 36, 40, 30 around the perimeter, the center line and the back divider. Restricted bleed or relief passages 50 positioned under the intermediate fasteners 38 allow for controlled, restricted bleed of air as may be needed in the event of impact.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A fitting and comfort system for a helmet, the system comprising an inflatable liner having an interior cavity into which air may be introduced with a first divider within the interior which segregates the interior of the liner into a first elongated cell and a second elongated cell extending substantially parallel to the first elongated cell, one or more passages extending through the first divider to permit air to pass between the first and second cells during an impact event associated with the use of the liner in a helmet to enable a substantially equal air pressure within the first and second cells, a second divider within the interior which segregates the second elongated cell into separate cells, and a single air inlet for introducing air into the interior cavity for inflating all of the cells of the liner to a substantially equal pressure.

2. A helmet, comprising a shell and a fitting and comfort system within the shell, the fitting and comfort system comprising an inflatable liner having an interior cavity into which air may be introduced with a first divider within the interior which segregates the interior of the liner into a first elongated cell and a second elongated cell extending substantially parallel to the first elongated cell, one or more passages extending through the first divider to permit air to pass between the first and second cells during an impact event associated with the use of the helmet to enable a substantially equal air pressure within the first and second cells, a second divider within the interior which segregates the second elongated cell into separate cells, and a single air inlet for introducing air into the interior cavity for inflating all of the cells of the liner to a substantially equal pressure.

* * * * *